US010519600B2

(12) United States Patent
Sorrentino et al.

(10) Patent No.: US 10,519,600 B2
(45) Date of Patent: Dec. 31, 2019

(54) YANKEE DRYER CYLINDER WITH IMPROVED INTERNAL GEOMETRY

(71) Applicant: A. CELLI PAPER S.P.A., Capannori (IT)

(72) Inventors: Salvatore Sorrentino, Pinerolo (IT); Guiseppe Antonini, Viareggio (IT)

(73) Assignee: A. CELLI PAPER S.P.A., Capannori (IT)

( * ) Notice: Subject to any disclaimer, the term of this patent is extended or adjusted under 35 U.S.C. 154(b) by 186 days.

(21) Appl. No.: 15/557,567

(22) PCT Filed: Mar. 14, 2016

(86) PCT No.: PCT/IB2016/051449
§ 371 (c)(1),
(2) Date: Sep. 12, 2017

(87) PCT Pub. No.: WO2016/147112
PCT Pub. Date: Sep. 22, 2016

(65) Prior Publication Data

US 2018/0051415 A1 Feb. 22, 2018

(30) Foreign Application Priority Data

Mar. 18, 2015 (IT) ..... PI2015A0021

(51) Int. Cl.
*F26B 11/02* (2006.01)
*D21F 5/02* (2006.01)
*D21F 5/18* (2006.01)

(52) U.S. Cl.
CPC ..... *D21F 5/021* (2013.01); *D21F 5/181* (2013.01)

(58) Field of Classification Search
CPC ..... D21F 7/12; D21F 5/021; D21F 5/181
See application file for complete search history.

(56) References Cited

FOREIGN PATENT DOCUMENTS

| | | |
|---|---|---|
| IT | 0000276295 | 3/2013 |
| IT | 0000277281 | 8/2013 |
| WO | 2008/105005 A1 | 9/2008 |
| WO | 2014/077761 A1 | 5/2014 |
| WO | 2015/000647 A1 | 1/2015 |

OTHER PUBLICATIONS

International Search Report dated Jun. 8, 2016 for Application No. PCT/IB2016/051449.

*Primary Examiner* — Jason Lau
(74) *Attorney, Agent, or Firm* — Ladas & Parry LLP; Malcolm J. MacDonald

(57) ABSTRACT

A Yankee dryer cylinder (1) having a cylindrical shell (10) having a central portion (11), a first and a second end portion (12, 13) and a longitudinal axis (101). At an internal surface (14), the cylindrical shell (10) includes a plurality of circumferential grooves (15). The cylinder (1) includes a first and a second head (20, 30) fixed, respectively, to the end portions (12, 13) of the cylindrical shell (10). The shell (10) includes a first and a second group of circumferential end grooves (15*a*, 15*b*, 15'*a*, 15'*b*) positioned respectively at the first and the second end portion (12, 13) and a third group of circumferential grooves positioned at the central portion (11). The grooves of the first and of the second group have a width that is greater than the width of the circumferential grooves positioned at the central portion, to uniformly distribute the loads in operating conditions.

12 Claims, 5 Drawing Sheets r1
10
l1
15a l1
l2
l'''
l''
d1
d2
d'''
d''
15''
15''
15'''
15a,15'a
15b,15'b

YANKEE DRYER CYLINDER WITH IMPROVED INTERNAL GEOMETRY

FIELD OF THE INVENTION

The present invention relates to the field of machines for producing paper and similar products and in particular relates to an improved structure of dryer cylinder, also known as Yankee cylinder, in particular a Yankee cylinder with improved internal geometry.

STATE OF THE ART

As well known, the plants for producing paper provide the use of a headbox which distributes a mixture of cellulosic fibres and water on a forming fabric, and sometimes additives of different kinds. In this way, a determined amount of water is drained by the centrifugal force, thus increasing the dry content of the layer of the mixture that is present on the forming fabric.

The content of water is, then, reduced, through a series of steps between more fabrics and/or felts of the mixture layer, up to obtain a consistency that allows the passage through a drying section. This usually comprises at least a Yankee dryer cylinder, also called "Yankee cylinder" and a drying hood that is fed with hot air. In particular, the web of treated wet paper is laid on the external surface of the Yankee cylinder, whilst the inside of the Yankee dryer cylinder is heated, for example, by introducing steam. The steam produced inside the Yankee dryer cylinder and the hot air, which is blown by the drying hood on the paper, cause the web of wet paper, which is laid on the external surface, to gradually be dried. When the desired value of drying is achieved, the web of paper is removed from the external surface of the Yankee dryer cylinder by means of a blade, or doctor blade, or by means of tensioning according to the desired product and in particular crepe paper, or smooth paper.

A Yankee dryer cylinder comprises essentially two heads, or end walls, between which a cylindrical shell in positioned. To each head a bearing journal is fixed that is mounted, in operating conditions, on a respective bearing. A hollow shaft is mounted inside the shell. The heads and/or the shell are provided with at least 2 inspection apertures through which at least a worker gets in the cylinder for periodically carrying out normal or extraordinary maintenance interventions.

The constituent elements of the Yankee cylinder, i.e. the heads, the shell, bearing journals etc. can be obtaining by melting of cast iron and can be fixed by bolting.

Alternatively, the Yankee cylinders can be made of steel. In this case the two heads can be fixed to the cylindrical shell by means of screw bolts, or more frequently by means of weld beads.

Both for the Yankee cylinders made of cast iron and made of steel, the cylindrical shell has an internal surface provided with circumferential grooves. These are arranged to collect the condensate that is formed for the transfer toward outside of the latent heat of vaporization from the steam that has been introduced inside the Yankee dryer cylinder.

Normally, the circumferential grooves have a same depth for all the length of the shell. See, for example, the document WO2008/105005 in this respect.

In WO2014/077761 is, instead, disclosed a Yankee dryer cylinder made of steel and comprising a cylindrical shell to which 2 heads are fixed, at opposite sides, by means of respective weld beads. The cylindrical shell has an internal surface provided with circumferential grooves. More precisely, the depth of the circumferential grooves gradually increases going from the more external grooves to the more internal grooves, i.e. the thickness of the cylindrical shell decreases. In the document is explained that this kind of geometry allows to simplify the production of the Yankee cylinder.

This technical solution, already largely used in the state of the art, and for example disclosed in the Italian patents IT276295 and IT277281 in the name of the same Applicant of the present application allows to make the cylinder highly resistant to stresses to which it is subjected in operating conditions, and at the same time to simplify the production with respect to other known solutions.

Nevertheless, the solutions that have been proposed have many drawbacks.

In operating conditions, the Yankee cylinders are subjected to high stresses, mainly thermoelastic stresses, due to the high temperature of the steam that has been introduced, to pressure stresses, compressive forces and to the stresses due to the centrifugal force acting during the rotation of the cylinder about the rotation axis. Normally, the highest values both of the thermoelastic stresses and of the pressure stresses are recorded at the contact zones between the heads and the shell. This determines the need to periodically carry out controls for verifying that structural failures are not present and however this causes a short service life of the Yankee cylinder.

SUMMARY OF THE INVENTION

It is then an object of the present invention to provide a Yankee dryer cylinder that allows, with respect to the Yankee cylinders of prior art, in operating conditions, to distribute more uniformly the stresses, in particular the thermoelastic stresses, the pressure stresses and the stresses produced by the centrifugal force, allowing to increase the performances and the service life of the cylinder.

This and other objects are achieved by the Yankee dryer cylinder, or Yankee cylinder, according to the present invention, comprising:

- a cylindrical shell having a central portion, a first and a second end portion and a longitudinal axis, said cylindrical shell being provided of a plurality of circumferential grooves at an internal surface;
- a first head, or end wall, fixed to said first end portion of said cylindrical shell;
- a second head, or end wall, positioned at the opposite side of said first head with respect to said cylindrical shell, said second head being fixed to said second end portion of said shell;
- a first bearing journal that is fixed to said first head;
- a second bearing journal that is fixed to said second head;
- a hollow shaft that is mounted inside said cylindrical shell and that is connected to said first and to said second head;

said circumferential grooves comprising:

- a first and a second group of circumferential end grooves positioned, respectively, at said first and said second end portion, each group of circumferential end grooves comprising at least a first and a second circumferential groove with said first circumferential groove that is positioned at a distance that is higher than the distance of said central portion with respect to said second circumferential groove;
- a third group of circumferential grooves positioned at said central portion;

whose main characteristic of said Yankee dryer cylinder is that said circumferential grooves of said first and of said second group have a width that is wider than the width of the circumferential grooves positioned at said central portion.

In particular, the technical solution according to the present invention allows to uniformly distribute the loads in operating conditions.

Preferably, the circumferential grooves of said first and of said second group have a depth that decreases going from the central portion toward the first and the second end portion of the cylindrical shell.

In an embodiment of the invention, each of said first and of said second end group of grooves comprises at least a first circumferential groove, a second circumferential groove and a third circumferential groove, positioned at distances that increase from said first, or second, head.

Preferably, the circumferential grooves have an extremity with a curvilinear profile having a predetermined radius of curvature.

In particular, the extremity of the circumferential grooves of the first and of the second end group of grooves have a radius of curvature r that is higher than the radius of curvature r" of the extremity of the circumferential grooves positioned at said central portion of the cylindrical shell, i.e. of the circumferential grooves of said third group, i.e. r>r".

Advantageously, the circumferential grooves have a depth that decreases, according to a predetermined function, going from the central portion toward the first, or the second, end portion.

In particular, the radius of curvature r of the extremity of the first and of the second circumferential groove of the first and of the second group is set between 9.5 and 10.5 mm. In a preferred embodiment the radius of curvature r is 10 mm.

In particular, the width 11 and 12 of the first and of the second circumferential groove of each end group of grooves can be set between 19 mm and 21 mm, for example can be equal to 20 mm.

In particular, the width 13 of the third circumferential groove of each end group of grooves can be set between 12 and 14 mm, for example can be equal to 12.8 mm.

In particular, an intermediate group of grooves can be provided between each of the first and of the second group of circumferential end grooves and the grooves of the third group.

Preferably, the intermediate group of grooves comprises only one groove.

Advantageously, the, or each, groove of the intermediate group has a width that is equal to the width of the grooves of the central portion. In particular, the depth d of the, or each, groove of the intermediate group can be set between the depth of the circumferential groove of the first, or the second, end group that is adjacent to the same and the depth of the circumferential grooves of the third group.

Advantageously, the extremity of the circumferential grooves positioned at the central portion of the cylindrical shell, i.e. belonging to the third group, have a curvilinear profile with radius of curvature r" set between 6 and 7 mm. In a preferred embodiment the radius of curvature r" is equal to 6.4 mm. Therefore, the width 1 of the grooves of the central portion can be set between 12 and 14 mm, for example can be equal to 12.8 mm.

In particular, the, or each, circumferential groove of the intermediate group has an extremity with a radius of curvature r'" set between 6 and 7 mm. In a preferred embodiment the radius of curvature of the, or each, circumferential groove of the intermediate group is 6.4 mm.

In particular, the first circumferential grooves of the first and of the second group, i.e. the grooves that are the closest to the heads, have a depth d1 set between 25 and 27 mm. In a preferred embodiment the depth d1 is 26 mm.

Advantageously, the second circumferential grooves of the first and the second group have a depth d2 set between 30 and 32 mm. In a preferred embodiment the depth d2 is 31 mm.

In an embodiment of the invention, the circumferential grooves of the third group have a depth dc set between 32 and 34 mm. In a preferred embodiment the depth dc is equal to 33 mm.

Advantageously, the, or each, circumferential groove of the intermediate group has a depth set between 31 and 33 mm. In a preferred embodiment the depth of the, or each, groove of the intermediate group is 32 mm.

In particular, the hollow shaft mounted inside the cylindrical shell in a coaxial position has a substantially cylindrical shape. More precisely, each end of the hollow shaft is connected, for example by bolting, to a respective bearing journal.

Advantageously, a first bearing journal is provided fixed to the first head and a second bearing journal fixed to the second head.

In particular, an end of each bearing journal is housed, in use, in a hole of a respective head, whilst the opposite end is mounted within a bearing.

More precisely, each bearing journal is fixed by bolting both to a respective head and to a respective end of the hollow shaft.

Advantageously, the first and the second head are butt welded to the cylindrical shell.

BRIEF DESCRIPTION OF THE DRAWINGS

The invention will be now shown with the following description of its exemplary embodiments, exemplifying but not limitative, with reference to the attached drawings in which.

DETAILED DESCRIPTION OF THE INVENTION

Figure 1:
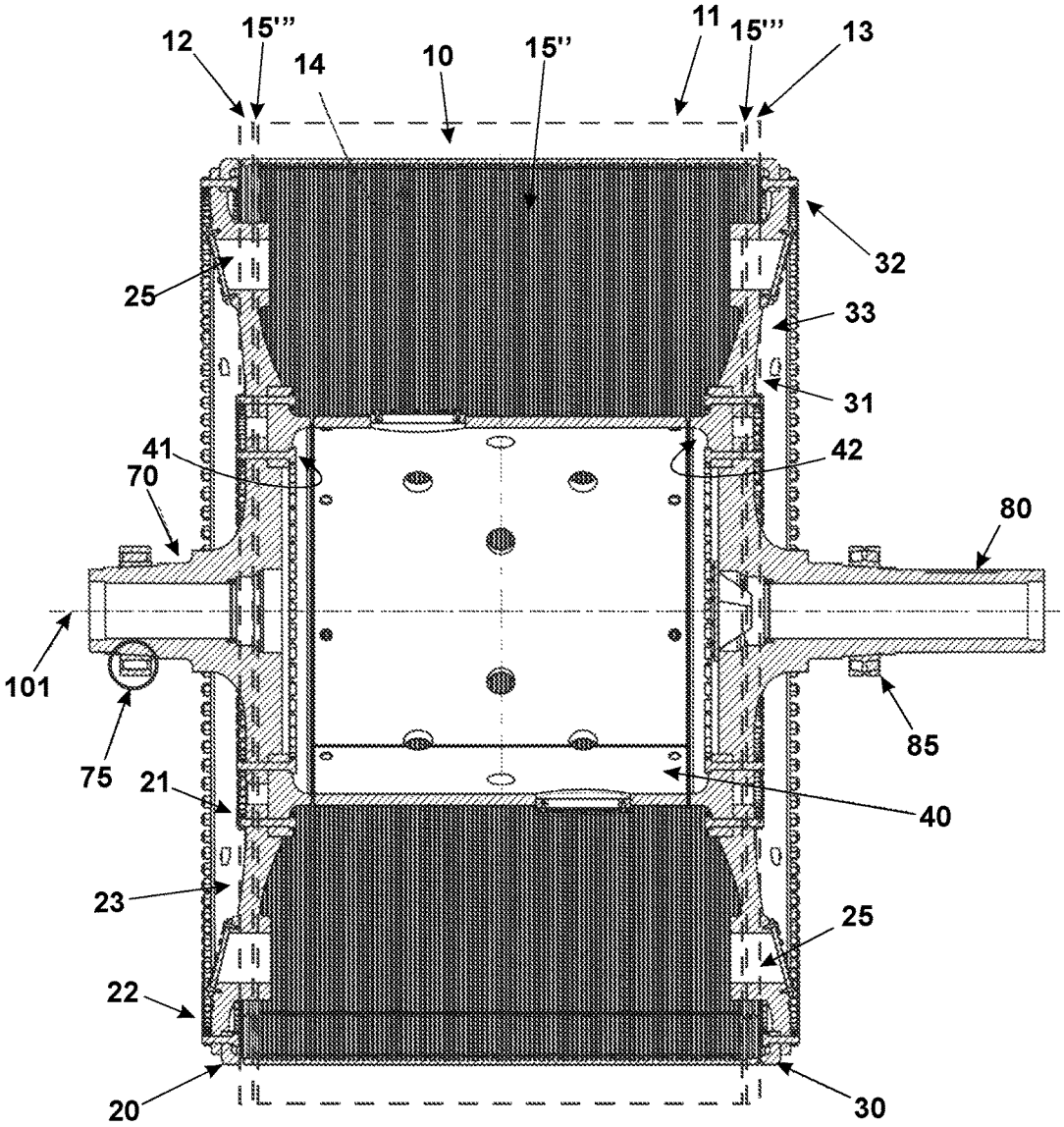
FIG. 1 diagrammatically shows an improved structure of Yankee cylinder, according to the invention, in a longitudinal-section view.

As diagrammatically shown in FIG. 1, a Yankee dryer cylinder 1, according to the present invention, comprises a cylindrical shell 10 having a longitudinal axis 101 and a first and a second head 20 and 30, or end walls, fixed to the opposite ends 12 and 13 of the cylindrical shell 10.

In an advantageous embodiment, each head 20, 30 comprises a central portion 21, 31 that is lowered toward the inside of the Yankee dryer cylinder 1 and an end portion 22, 32 that is connected to the central lowered portion 21, 31 through a connection portion 23, 33. This can be substantially flat, or curved, i.e. substantially concave. At the connection portion 23, 33 the head 20, 30 can be provided with at least an inspection aperture 25, for example 2 inspection apertures. These assure that, during the assembly, or maintenance operations, the staff can work in safety. In a possible embodiment each connection portion of each head with 2 inspection apertures are positioned at 180 degrees.

In particular, each inspection aperture 25 has a tubular shape. The tubular shape of the inspection apertures 25 allows to simplify and improve the dynamic balancing of the whole structure and to help the staff to enter inside the Yankee dryer cylinder 1. The tubular entrance of the inspection apertures, furthermore, increases the structural stiffness of the head and therefore of the whole Yankee cylinder.

The Yankee dryer cylinder 1 comprises, furthermore, a first bearing journal 70 fixed to the first head 20 and a second bearing journal 80 fixed to the second head 30. The fixing of the bearing journals 70 and 80 to the respective heads can be made by means of bolting. In particular, a first end of each bearing journal 70, 80 is housed, in use, in a hole of a respective head 20, or 30, and the opposite end is mounted within a bearing 75, or 85.

Inside the cylindrical shell 10 a hollow shaft 40 that is positioned coaxially to the cylindrical shell and that is connected by means of by bolting to the first head 20, at a first end 41, and to the second head 30, at a second end 42 opposite to the first. Each end 41, 42 of the hollow shaft 40 is then fixed, by means of bolts, to a respective bearing journal 70, 80.

As well known, the cylindrical shell 10, at an internal surface 14, is provided with a plurality of circumferential grooves 15 within which the condensate is collected that is formed for the transfer toward outside of the latent heat of vaporization from the steam that has been introduced inside the Yankee dryer cylinder 1.

According to the invention, the circumferential grooves 15 can be ideally divided in a first group of circumferential end grooves, for example comprising 2 circumferential grooves 15*a* and 15*b*, positioned at the first end portion 12, a second group of circumferential end grooves, also this comprising, in the case shown in figure, 2 circumferential grooves 15'*a* and 15'*b*, positioned at the second end portion 13 and a third group of circumferential grooves, comprising a predetermined number of grooves 15", positioned at the central portion 11 of the shell 10. More precisely, the circumferential grooves of the first and the second group have a width that is wider than width l of the circumferential grooves 15" positioned at the central portion 11. The circumferential grooves 15" of the central portion 11, i.e. belonging to the third group, are preferably all equal, i.e. all of them have a same width and a same depth.

Preferably, at least the circumferential grooves of the first and of the second group have a curvilinear profile. According to the invention, the extremity of the circumferential grooves of the first and the second group are curvilinear and have a radius of curvature r that is higher than the radius of curvature r" of the circumferential grooves 15" positioned at the central portion of the cylindrical shell, i.e. r>r".

More precisely, in a preferred embodiment of the invention, each end group of grooves comprises at least a first circumferential groove 15*a*, or 15'*a* and a second circumferential groove 15*b*, or 15'*b*. More precisely, the second circumferential groove 15*b*, or 15'*b*, is positioned at a distance that is higher than the distance of the first head 20, or from the second head 30, with respect to the first circumferential groove 15*a*, or 15'*a* of the same group. In a modification of the invention, each end group of grooves, furthermore, comprises a third circumferential groove 15*c*, or 15'*c*. In this case, the third circumferential groove 15*c*, or 15'*c* is positioned at a distance from the heads 20, 30 that is higher than the distance of the first and the second circumferential groove of the same group.

More in detail, the radius of curvature r of the first and of the second circumferential groove 15*a*, 15*b* and 15'*a*, 15'*b* of the first and of the second group is set between 9.5 and 10.5 mm, for example r=10 mm.

As for example shown in figure, between the first, or the second, group of circumferential end grooves and the grooves of said third group an intermediate group of circumferential grooves 15'" is provided. In particular, the intermediate group of grooves comprises at least a circumferential groove having a width l'" that is equal to the width l" of the grooves 15" of the central portion 11, but a depth d that is set between the depth of the circumferential groove 15*b*, or 15'*b*, of the first, or the second, end group that is to it adjacent and the depth of the circumferential grooves 15" of the third group. In a provided embodiment, also the circumferential grooves 15'" of the intermediate group have a curvilinear shape. In particular, the extremity of the circumferential grooves 15'" of the intermediate group can have a radius of curvature r'" set between 6 and 7 mm, preferably r'"=6.4 mm. Also the circumferential grooves 15" that are positioned at the central portion 11 of the cylindrical shell can have a radius of curvature r" set between 6 and 7 mm, preferably r"=6.4 mm.

Concerning the depth of the first circumferential grooves 15*a* and 15'*a* of the first and of the second group it has been demonstrated that the ideal conditions are met with a depth d1 set between 25 and 27 mm, preferably d1=26 mm. Analogously, the second circumferential grooves 15*b*, 15'*b* of the first and the second group have preferably a depth d2 set between 30 and 32 mm, preferably d2=31 mm.

In an embodiment of the invention, the circumferential grooves 15'" of the intermediate group have a depth d'" set between 31 and 33 mm, preferably a depth d'"=32 mm.

Figures 2, 3:
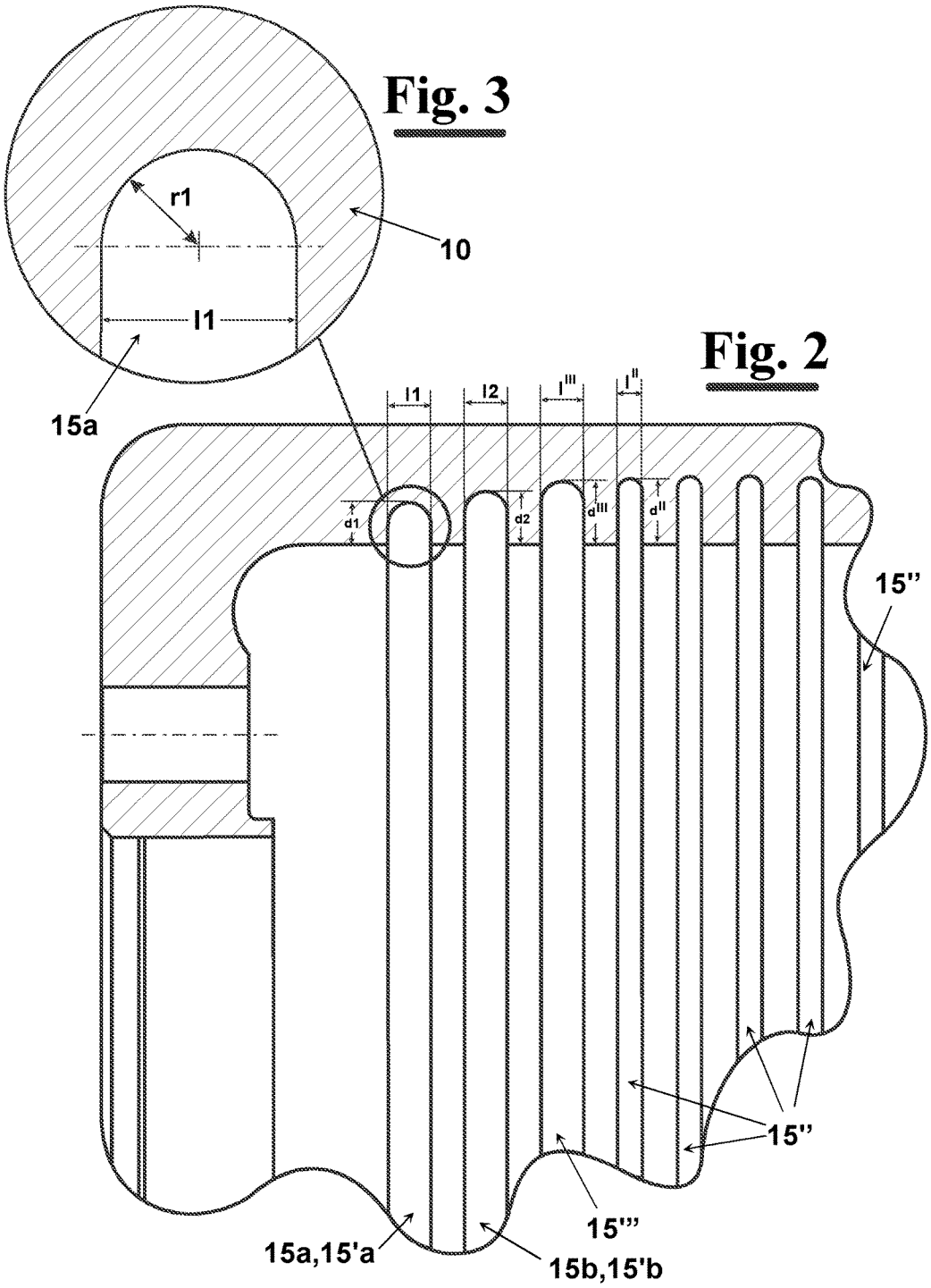
FIG. 2 diagrammatically shows the trend of the circumferential grooves of the Yankee cylinder, according to the invention.
FIG. 3 shows an enlargement of a circumferential groove of the Yankee dryer cylinder of FIG. 2.
Figure 4:
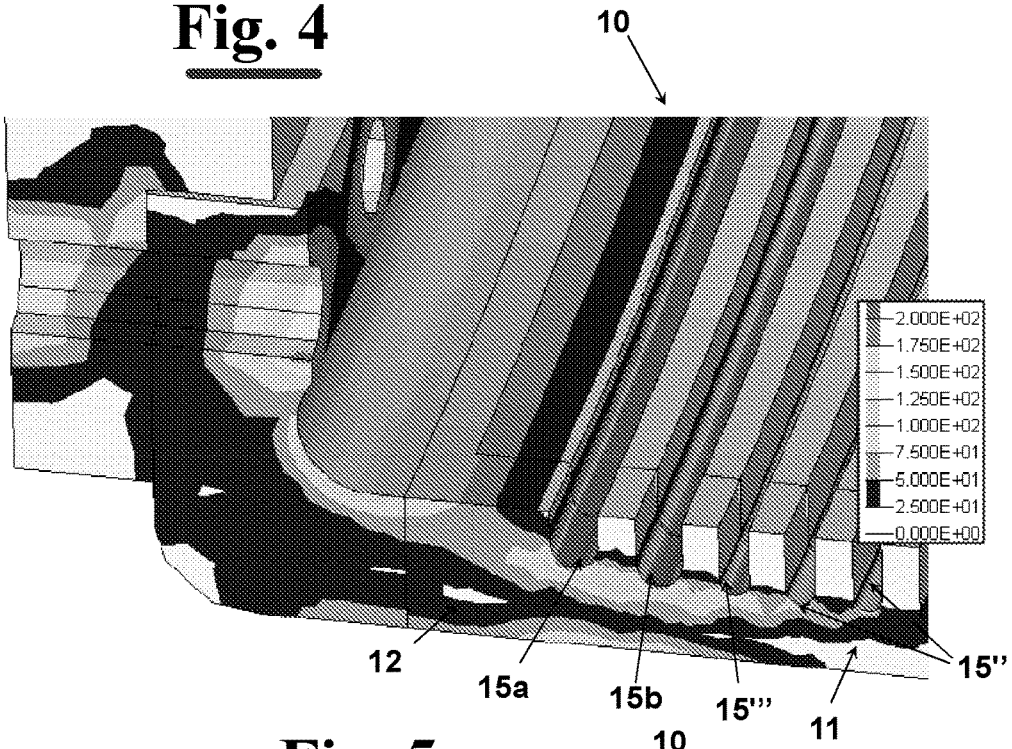
FIGS. 4 to 8 show the results of the finite elements analysis carried out on the improved structure of Yankee cylinder, according to the invention.
Figure 5:
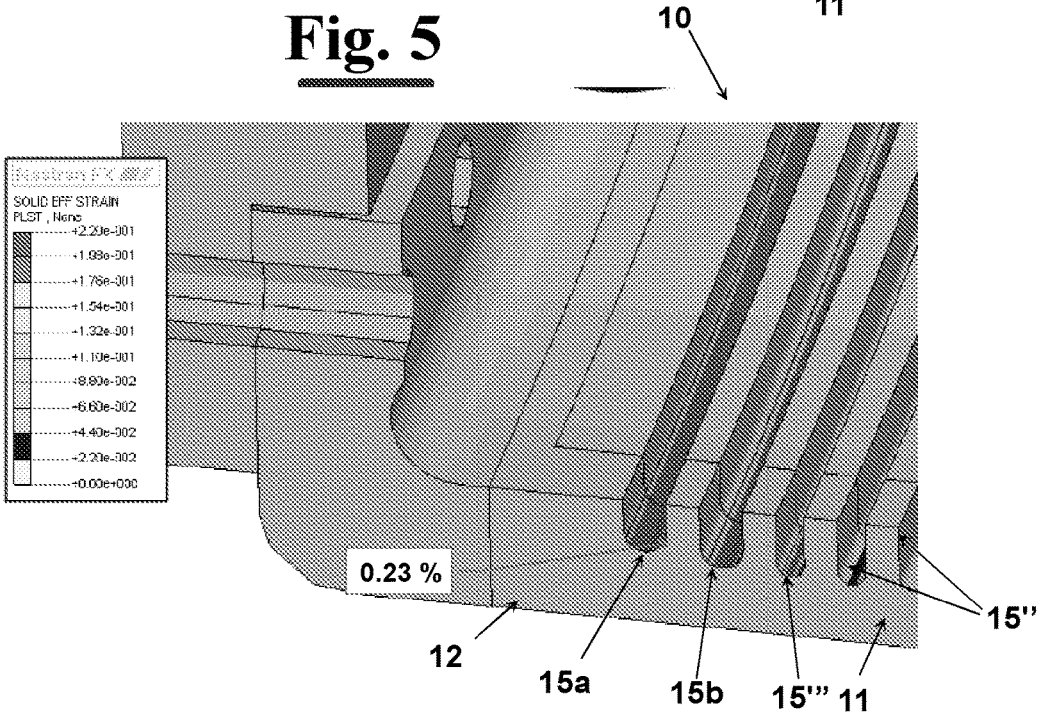
Figure 6:
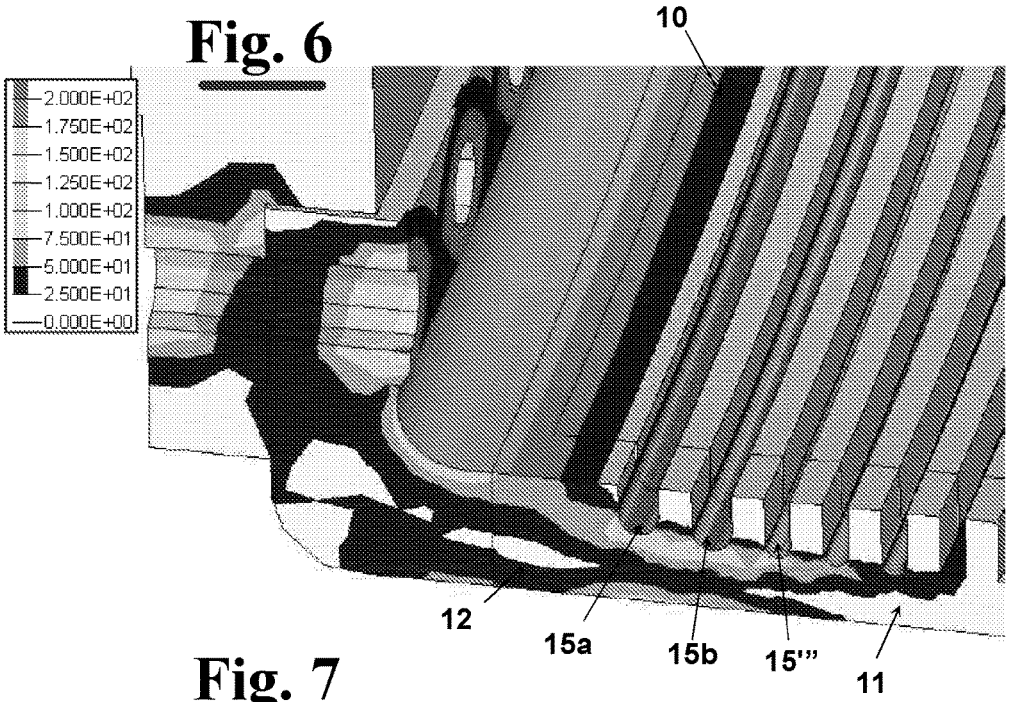
Figure 7:
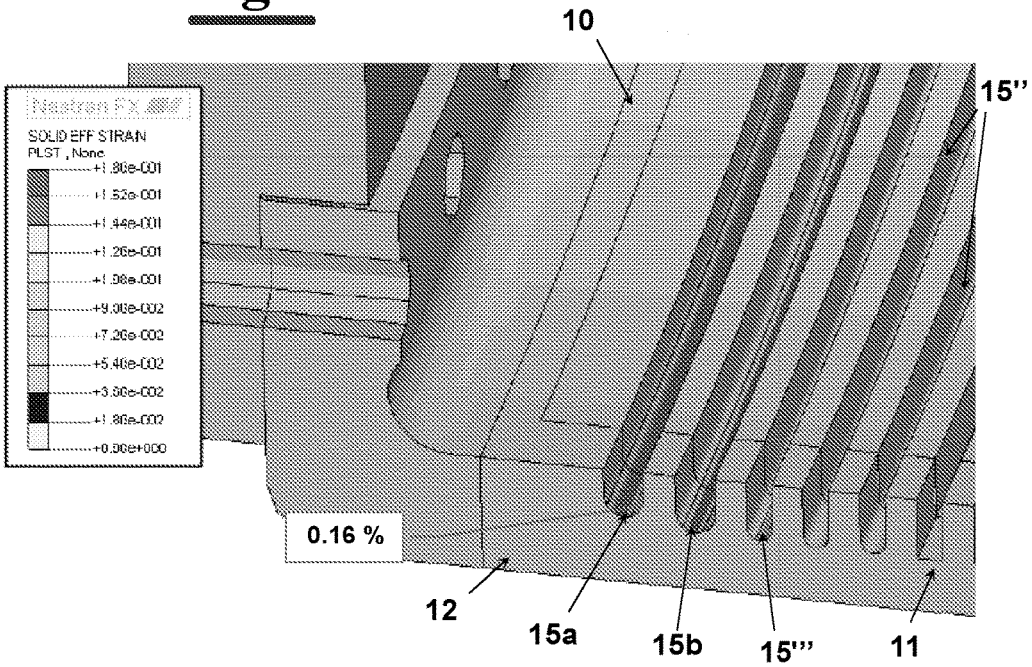
Figure 8:
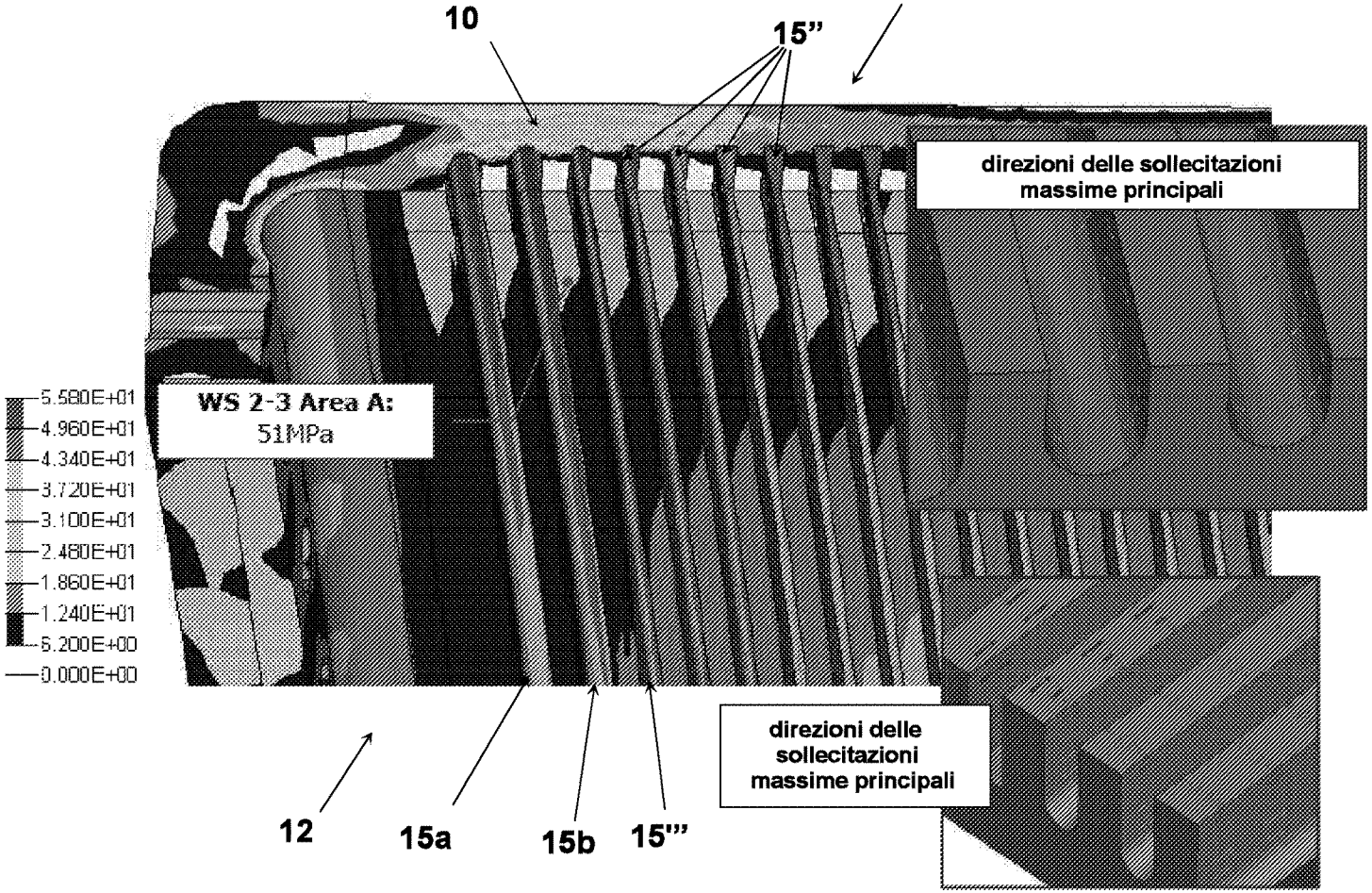

As for example shown in FIG. 2, the depth of the first 4 grooves increases, i.e. d">d'">d2>d1. All the grooves 15" of the central portion 11 have a same depth d", for example d"=33 mm.

In a preferred embodiment, the heads 20 and 30, the hollow shaft 40 and the bearing journals 70 and 80 are made of cast iron. More precisely, the heads 20 and 30 are fixed by means of bolts to respective ends of the cylindrical shell 10. Analogously, each end 41, 42 of the hollow shaft 40 is fixed by means of bolts to a respective bearing journal 70, 80. Each end 41, 42 of the hollow shaft 40 is, furthermore, fixed, by bolting, to a respective head 20, 30. The cylindrical shell 10 can be made of cast iron, or made of steel. More precisely, each end 11 and 12 of the cylindrical shell 10 is fixed by bolting to a respective head 20 and 30.

In order to demonstrate the advantages of the Yankee dryer cylinder according to the present invention with respect to the Yankee cylinders of the prior art, a finite elements analysis has been carried out.

For the finite elements analysis, the ASME standards VIII Division 2—Ed. 2010+Ad. 2011 and ASME II—Ed. 2010+Ad. 2011 have been used.

Mathcad 15 software (PTC software) has been used for the parameterisation of the profile.

The following programs have been used for the multiphysics finite elements analysis:

- FEMAP V10.3.1 (Siemens Industry): model generation, post-processing;
- NEiNastran V10.1 (NEiSoftware Inc.): FE Analysis (non-linear static).

The results obtained with the finite elements analysis are shown in FIGS. 4 to 8.

If the radius of curvature of the first 2 grooves, i.e. the grooves belonging to the end groups, is increased to r=10 mm, whilst the successive grooves have a radius of 6.4 mm, a "distension" of the stresses is obtained, i.e. a decrease of the tension with respect to the situation where the first 2 grooves have a radius equal to 6.4 mm.

The decrease of the depth within the shell 10 prevents, furthermore, structural weakening due to the decreases of the resistant section.

In particular from the FIGS. 4 to 8 it is noted that the constructive solution according to the present invention allows to distribute the stresses much more uniformly with respect to the prior art solutions.

In fact, as known, in operating conditions, in the Yankee cylinders of prior art the stresses are concentrated in determined points of the structure. This determines, over time, a weakening in those zones and, therefore, a decrease, in general, of the service life of the cylinder.

CONCLUSIONS

Thanks to the profile of the grooves according to the invention, therefore, it is possible to overcome problems of local increase of the stresses optimizing the efficiency of working and increasing, in practice, the average service life of the Yankee dryer cylinders having the geometry according to the present invention.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A Yankee dryer cylinder comprising:

a cylindrical shell comprising a central portion, a first and a second end portion and having a longitudinal axis, said cylindrical shell, at an internal surface, being provided with a plurality of circumferential grooves;

a first head, or end wall, fixed to said first end portion of said cylindrical shell;

a second head, or end wall, positioned at the opposite side of said first head with respect to said cylindrical shell, said second head being fixed to said second end portion of said shell;

a first bearing journal fixed to said first head;

a second bearing journal fixed to said second head;

a hollow shaft mounted inside said cylindrical shell and connected to said first and said second head;

said circumferential grooves comprising:

a first and a second group of circumferential end grooves positioned at said first and of said second end portion, respectively, each group of circumferential end grooves comprising at least a first and a second circumferential groove with said first circumferential groove positioned at a distance from said central portion that is higher with respect to the distance of said second circumferential groove of the same group;

a third group of circumferential grooves positioned at said central portion;

wherein said circumferential grooves of said first and of said second group have a width that is wider than the width of the circumferential grooves positioned at said central portion, in such a way to uniformly distribute the loads in operating conditions.

2. The Yankee dryer cylinder, according to claim 1, wherein said circumferential grooves of said first and of said second group have a depth that decreases going from said central portion toward said first and said second end portion of said cylindrical shell.

3. The Yankee dryer cylinder, according to claim 1, wherein each of said first and of said second end group of grooves comprises at least a first circumferential groove, a second circumferential groove, and a third circumferential groove, positioned at a distance from said first, or second, head that increases going from the first to the third circumferential groove.

4. The Yankee dryer cylinder, according to claim 1, wherein said circumferential grooves of said first and of said second end group of grooves have a width set between 19 mm and 21 mm.

5. The Yankee dryer cylinder, according to claim 1, wherein said circumferential grooves have curvilinear extremities having a predetermined radius of curvature and wherein the curvilinear extremities of said circumferential grooves of said first and of said second end group of grooves have a radius of curvature r that is higher than the radius of curvature r" of the curvilinear extremities of the circumferential grooves of said third group.

6. The Yankee dryer cylinder, according to claim 5, wherein said radius of curvature r of said extremity of said first and of said second circumferential groove of said first and of said second group is set between 9.5 and 10.5 mm.

7. The Yankee dryer cylinder, according to claim 1, wherein, between each of said first and said second group of circumferential end grooves, and said grooves of said third group, an intermediate group of circumferential grooves is provided, said intermediate group comprising at least one circumferential groove having a width that is equal to the width of said grooves of said central portion, and a depth d'" set between the depth of the circumferential groove of said first, or second, end group that is adjacent to it, and the depth d" of the circumferential grooves of said third group.

8. The Yankee dryer cylinder, according to claim 1, wherein the extremity of said circumferential grooves of said third group is curvilinear and has a radius of curvature r set between 6 and 7 mm.

9. The Yankee dryer cylinder, according to claim 1, wherein said first circumferential grooves of said first and of said second group have a depth d1 set between 25 and 27 mm.

10. The Yankee dryer cylinder, according to claim 1, wherein said second circumferential grooves of said first and of said second group have a depth d2 set between 30 and 32 mm.

11. The Yankee dryer cylinder, according to claim 1, wherein said circumferential grooves of said third group have a depth d" set between 32 and 34 mm.

12. The Yankee dryer cylinder, according to claim 1, wherein said heads, said hollow shaft, and said bearing journals are made of cast iron, said heads being fixed to said shell by means of bolts, and wherein said hollow shaft mounted in a coaxial position inside said cylindrical shell is substantially cylindrical-shaped, each end of said hollow shaft being connected by means of bolts to a respective bearing journal, said shell made of a material selected from the group consisting of cast iron and steel.

* * * * *